US007364694B2

(12) United States Patent
Tornier

(10) Patent No.: US 7,364,694 B2
(45) Date of Patent: Apr. 29, 2008

(54) PROCESS FOR THE STERILE PACKAGING OF A POLYETHYLENE PROSTHETIC IMPLANT

(75) Inventor: Alain Tornier, Saint Ismier (FR)

(73) Assignee: Tornier, Saint Ismier (FR)

( * ) Notice: Subject to any disclaimer, the term of this patent is extended or adjusted under 35 U.S.C. 154(b) by 103 days.

(21) Appl. No.: 10/730,276

(22) Filed: Dec. 9, 2003

(65) Prior Publication Data

US 2004/0134821 A1 Jul. 15, 2004

(30) Foreign Application Priority Data

Dec. 10, 2002 (FR) ..... 02 15600

(51) Int. Cl.
*A51L 2/08* (2006.01)

(52) U.S. Cl. ..... 422/23; 422/22; 53/425

(58) Field of Classification Search ..... 422/22, 422/23, 40

See application file for complete search history.

(56) References Cited

U.S. PATENT DOCUMENTS 4,332,845 A * 6/1982 Nawata et al. ..... 206/204
5,171,289 A 12/1992 Tornier
5,236,088 A 8/1993 Dhority et al.
5,314,485 A 5/1994 Judet
5,326,359 A 7/1994 Oudard
5,358,526 A 10/1994 Tornier
5,405,399 A 4/1995 Tornier
5,429,639 A 7/1995 Judet
5,458,650 A 10/1995 Carrett et al.
5,505,731 A 4/1996 Tornier
5,591,168 A 1/1997 Judet et al.
5,662,651 A 9/1997 Tornier et al.
5,676,702 A 10/1997 Ratron
5,702,447 A 12/1997 Walch et al.
5,702,457 A 12/1997 Walch et al.
5,702,478 A 12/1997 Tornier
5,766,256 A 6/1998 Oudard et al.
5,824,106 A 10/1998 Fournol
5,879,395 A 3/1999 Tornier et al.
5,881,534 A 3/1999 Ahlqvist et al.
6,162,254 A 12/2000 Timoteo (Continued)

FOREIGN PATENT DOCUMENTS

EP 0737481 10/1996

(Continued)

OTHER PUBLICATIONS

Rochetin, U.S. Appl. No. 11/194,452, entitled "Patellar Retractor and Method of Surgical Procedure on Knee," filed Aug. 2, 2005.

(Continued)

*Primary Examiner*—E. Leigh McKane
(74) *Attorney, Agent, or Firm*—Faegre & Benson LLP

(57) ABSTRACT

A prosthetic implant made of polyethylene is packaged in a sterile manner by being placed in a flexible, gas-impermeable sachet after which a vacuum is created in the sachet and it is hermetically closed. The sachet is subsequently placed in a gas-impermeable envelope and an inert gaseous atmosphere is established in the envelope and the envelope is closed hermetically. The assembly formed by the implant, the sachet and the envelope is then exposed to radiation.

31 Claims, 3 Drawing Sheets

U.S. PATENT DOCUMENTS

| | | | |
|---|---|---|---|
| 6,165,224 | A | 12/2000 | Tornier |
| 6,168,629 | B1 | 1/2001 | Timoteo |
| 6,171,341 | B1 | 1/2001 | Boileau et al. |
| 6,183,519 | B1 | 2/2001 | Bonnin et al. |
| 6,206,925 | B1 | 3/2001 | Tornier |
| 6,299,646 | B1 | 10/2001 | Chambat et al. |
| 6,328,758 | B1 | 12/2001 | Tornier et al. |
| 6,334,874 | B1 | 1/2002 | Tornier et al. |
| 6,379,387 | B1 | 4/2002 | Tornier |
| 6,454,809 | B1 | 9/2002 | Tornier |
| 6,488,712 | B1 | 12/2002 | Tornier et al. |
| 6,540,770 | B1 | 4/2003 | Tornier et al. |
| 6,582,469 | B1 | 6/2003 | Tornier |
| 6,599,295 | B1 | 7/2003 | Tornier et al. |
| 6,626,946 | B1 | 9/2003 | Walch et al. |
| 6,761,740 | B2 | 7/2004 | Tornier |
| 6,767,368 | B2 | 7/2004 | Tornier |
| 6,802,864 | B2 | 10/2004 | Tornier |
| 6,824,567 | B2 | 11/2004 | Tornier et al. |
| 6,890,357 | B2 | 5/2005 | Tornier |
| 6,969,406 | B2 | 11/2005 | Tornier |
| 7,033,396 | B2 | 4/2006 | Tornier |
| 7,302,784 | B2 | 12/2007 | Harges et al. |
| 2003/0009170 | A1 | 1/2003 | Tornier |
| 2003/0009171 | A1 | 1/2003 | Tornier |
| 2003/0028198 | A1 | 2/2003 | Tornier et al. |
| 2004/0210220 | A1 | 10/2004 | Tornier |
| 2004/0215200 | A1 | 10/2004 | Tornier et al. |
| 2004/0230197 | A1 | 11/2004 | Tornier et al. |
| 2005/0049709 | A1 | 3/2005 | Tornier |
| 2005/0055102 | A1 | 3/2005 | Tornier et al. |
| 2005/0165490 | A1 | 7/2005 | Tornier |
| 2005/0203536 | A1 | 9/2005 | Laffargue et al. |
| 2005/0278030 | A1 | 12/2005 | Tornier et al. |
| 2005/0278031 | A1 | 12/2005 | Tornier et al. |
| 2005/0278032 | A1 | 12/2005 | Tornier et al. |
| 2005/0278033 | A1 | 12/2005 | Tornier et al. |
| 2005/0288791 | A1 | 12/2005 | Tornier et al. |
| 2006/0015185 | A1 | 1/2006 | Chambat et al. |
| 2006/0173457 | A1 | 8/2006 | Tornier |
| 2006/0235538 | A1 | 10/2006 | Rochetin et al. |

FOREIGN PATENT DOCUMENTS

| | | |
|---|---|---|
| EP | 0982236 | 3/2000 |
| GB | 1097637 | 1/1968 |
| WO | 9414657 | 7/1994 |

OTHER PUBLICATIONS

Rochetin et al., U.S. Appl. No. 11/401,415, entitled "Surgucal Apparatus for Implantation of a Partial or Total Knee Prosthsis, " filed Apr. 11, 2006.

Rochetin, U.S. Appl. No. 11/670,274, entitled "Offset Stem Tibial Implantation," filed Feb. 1, 2007.

Ratron et al., U.S. Appl. No. 11/626,735, entitled "Surgical Instrumentation Kit for Inserting an Ankle Prothesis," filed Jan. 24, 2007.

* cited by examiner

PROCESS FOR THE STERILE PACKAGING OF A POLYETHYLENE PROSTHETIC IMPLANT

BACKGROUND OF THE INVENTION

1. Field of the Invention

The present invention relates to a process for the sterile packaging of a prosthetic implant made of polyethylene.

The invention is particularly applicable to the packaging of high density polyethylene (HDPE) implants, particularly for knee or hip prostheses.

2. Brief Description of the Related Art

Between their manufacture and their implantation in a living being, such implants must be stored under good conditions of sterility, while allowing transport thereof. In order to sterilize these pieces which do not withstand high temperatures, it is known to use ionizing rays, particularly γ (gamma) rays. Moreover, in order to ensure that no subsequent contamination occurs, the implants are packed so as to be impermeable to the ambient air.

However, it is now known that, if polyethylene implants are exposed to radiation while the gaseous atmosphere surrounding the implants contains oxygen, phenomena of oxidation of the polyethylene occurs. More precisely the exposure to radiation provokes the break of polyethylene chains of the polyethylene which, in the presence of oxygen, recombine with the latter, leading to the reduction of the molecular weight of the polyethylene and to the degradation of its mechanical properties. In the absence of oxygen, polyethylene chains recombine together, increasing the rate of cross-linking of the polyethylene, which guarantees good mechanical properties of the implant.

This is the reason why one type of process presently employed consists in firstly placing an implant in a flexible, gas-impermeable sachet, then in creating a vacuum in this sachet before closing it hermetically, and finally in sterilizing the implant contained in the sachet in vacuo by exposure to radiation.

Nonetheless, the use of such a sachet in vacuo is delicate as it is difficult to guarantee the long-term integrity of the package, particularly during transport thereof. Any defect in the closure of the sachet or the presence of a weak or fragile area of the sachet will compromise the sterile packaging of the implant.

It is an object of the present invention to propose a process of the afore-mentioned type, in which a polyethylene implant is sterilized satisfactorily while guaranteeing a long-term sterile environment of the implant, particularly during transport thereof.

SUMMARY OF THE INVENTION

The invention relates to a process in which, successively, the implant is placed in a flexible, gas-impermeable sachet, a vacuum is created in the sachet and the sachet sealed at an opening therein. At a time there after the implant that has been placed in the sachet in vacuo is sterilized by irradiation. The invention is characterized in that it comprises steps carried out successively before the irradiation of the implant placed in the first sachet in vacuo and consisting in:

- placing the sachet in vacuo containing the implant in a gas-impermeable envelope having an opening adapted to be sealed,
- forming an inert gaseous atmosphere in the envelope, and
- closing the envelope hermetically by sealing its opening.

The packaging obtained by such a process guarantees that the ambient air, particularly the oxygen that it contains, cannot come into contact with the implant, even if the integrity of the sachet is compromised.

According to other characteristics of this process, taken separately or in any technically possible combinations:

- closure of the sachet and/or of the envelope is effected by heat-sealing of their respective openings;
- the inert gaseous atmosphere formed in the envelope is constituted by argon, nitrogen or a mixture of these gaseous elements;
- the sachet comprises a layer of aluminum;
- the envelope comprises a layer of polyamide and a layer of polyethylene.

To form the inert gaseous atmosphere in the envelope, the process comprises steps consisting in:

- creating a vacuum around and inside the envelope, and
- injecting an inert gas inside the envelope until the pressure inside the envelope reaches a predetermined value, strictly less than atmospheric pressure, and, after having hermetically closed the envelope, the latter is subjected to atmospheric pressure.

The inert gas is injected in calibrated manner.

Before or after irradiation of the implant, the assembly formed by the implant, the sachet and the envelope is placed in a rigid packing whose internal volume is substantially equal to the volume occupied by the envelope.

Before placing the assembly formed by the implant, the sachet and the envelope in the rigid packing, the envelope is folded on itself.

The rigid packing and the envelope have complementary shapes in order to immobilize the sachet containing the implant.

BRIEF DESCRIPTION OF THE DRAWINGS

The invention will be more readily understood on reading the following description given solely by way of example and made with reference to the accompanying drawings, in which.

DESCRIPTION OF PREFERRED EMBODIMENTS

Figure 1:
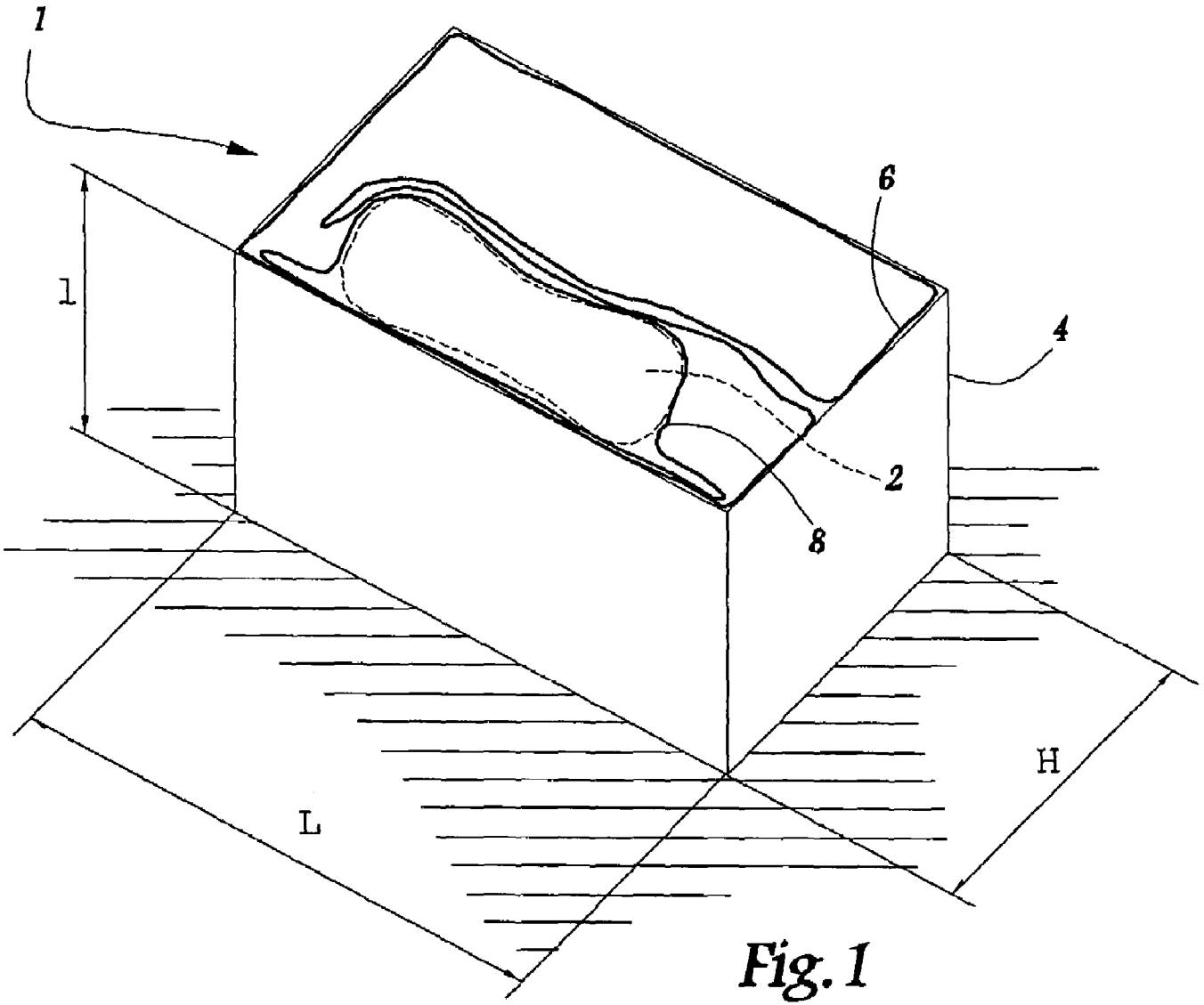
FIG. 1 is a view in perspective of a packaging obtained by a process according to the invention.

Referring now to the drawings, FIG. 1 shows a sterile packaging 1 for a prosthetic implant 2, comprising an outer packing 4, an outer envelope 6 and an inner sachet 8.

The implant 2 is for example an acetabulum made of high density polyethylene.

The outer packing 4 forms a rigid box of parallelepipedic shape, of dimensions L×1×H, as indicated in FIG. 1. This box is open on at least one of these faces. It is, for example, made of cardboard.

The outer envelope 6 has a multi-layer structure and comprises at least one layer of polyamide and one layer of polyethylene, rendering it both flexible and gas-impermeable. Taking into account the conventional methods of manufacturing such an envelope, its impermeability is not necessarily strictly perfect.

The inner sachet 8 also has a multi-layer structure and comprises at least one layer of aluminum and an inner layer of polyamide, rendering it both flexible, gas-impermeable and opaque to visible light.

Other characteristics of the outer envelope and of the inner sachet will appear from the following description of an example of a process of packing in carried out in order to obtain the packing in 1. In the following specification, the pressures indicated are absolute pressures.

Figure 2:
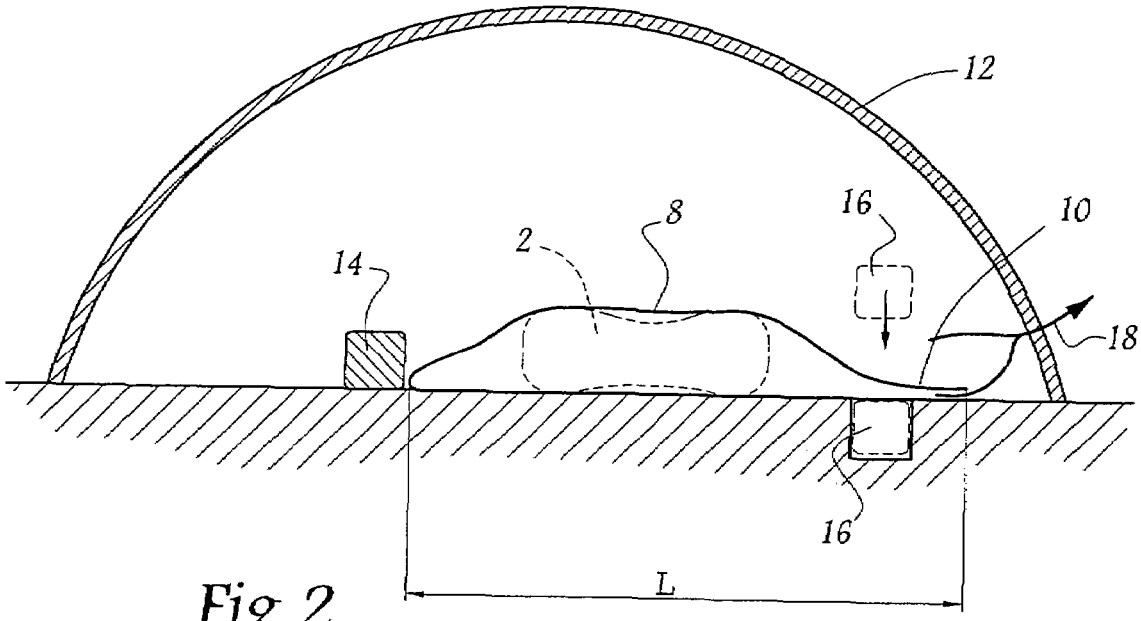
FIG. 2 is a schematic view illustrating a first phase of the process carried out to obtain the packaging of FIG. 1.

As shown in FIG. 2, the implant 2 is firstly placed in the inner sachet 8, of which the dimensions, flat, are advantageously a length of about L and a width of about 1. To that end, the sachet 8 comprises an opening 10 adapted to be sealed by fusion of the polyamide forming the inner layer of the sachet 8. The sachet 8 containing the implant 2 is positioned beneath a bell 12, using a positioning bar 14 whose position is pre-established so that the opening 10 of the sachet 8 is disposed between open heat-sealing jaws 16. The bell 12 is provided with vacuum-creating means (not shown).

Figure 3:
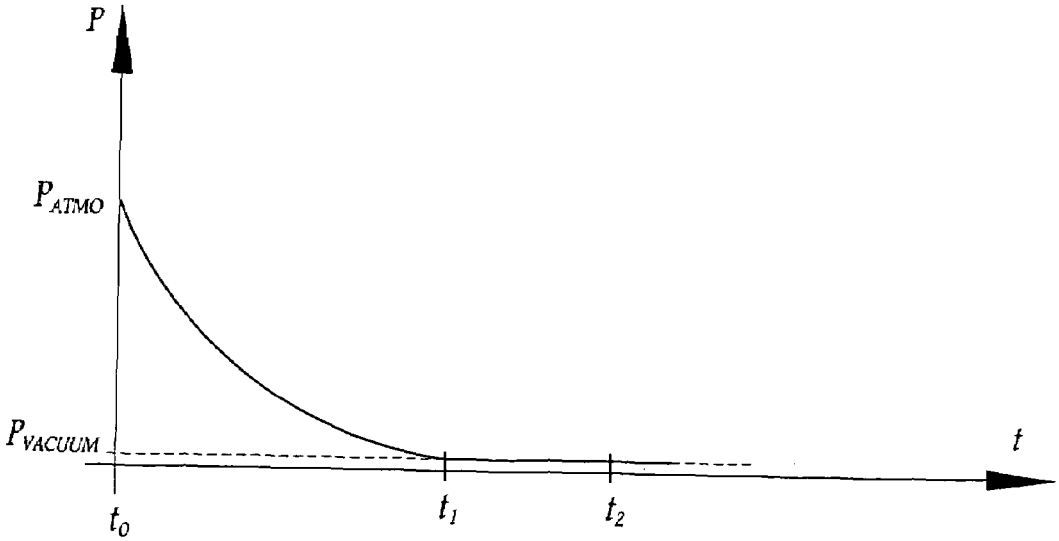
FIG. 3 is a diagram showing the variation of pressure as a function of time within a sachet used in the first phase of the process illustrated in FIG. 2.

More precisely, during a step represented between instants $t_0$ and $t_1$ in FIG. 3, the air initially contained in the bell 12 is evacuated therefrom, including that contained in the sachet 8, as symbolized by arrow 18 in FIG. 2, until the pressure prevailing in the sachet 8 attains a value of some millibars, denoted $P_{VACUUM}$ in FIG. 3.

At instant $t_1$, the jaws 16 are then closed on themselves and, from $t_1$ to $t_2$, these jaws weld the edges of the opening 10 to each other, locally taking the polyamide forming the inner layer of the sachet to its melting temperature.

At instant $t_2$, the jaws are opened again and the chamber defined by the bell 12 is re-pressurized. The sachet 8 being hermetically closed, the pressure prevailing inside this sachet 8 remains substantially equal to the pressure $P_{VACUUM}$. The quality of the weld may then be visually checked.

Figure 4:
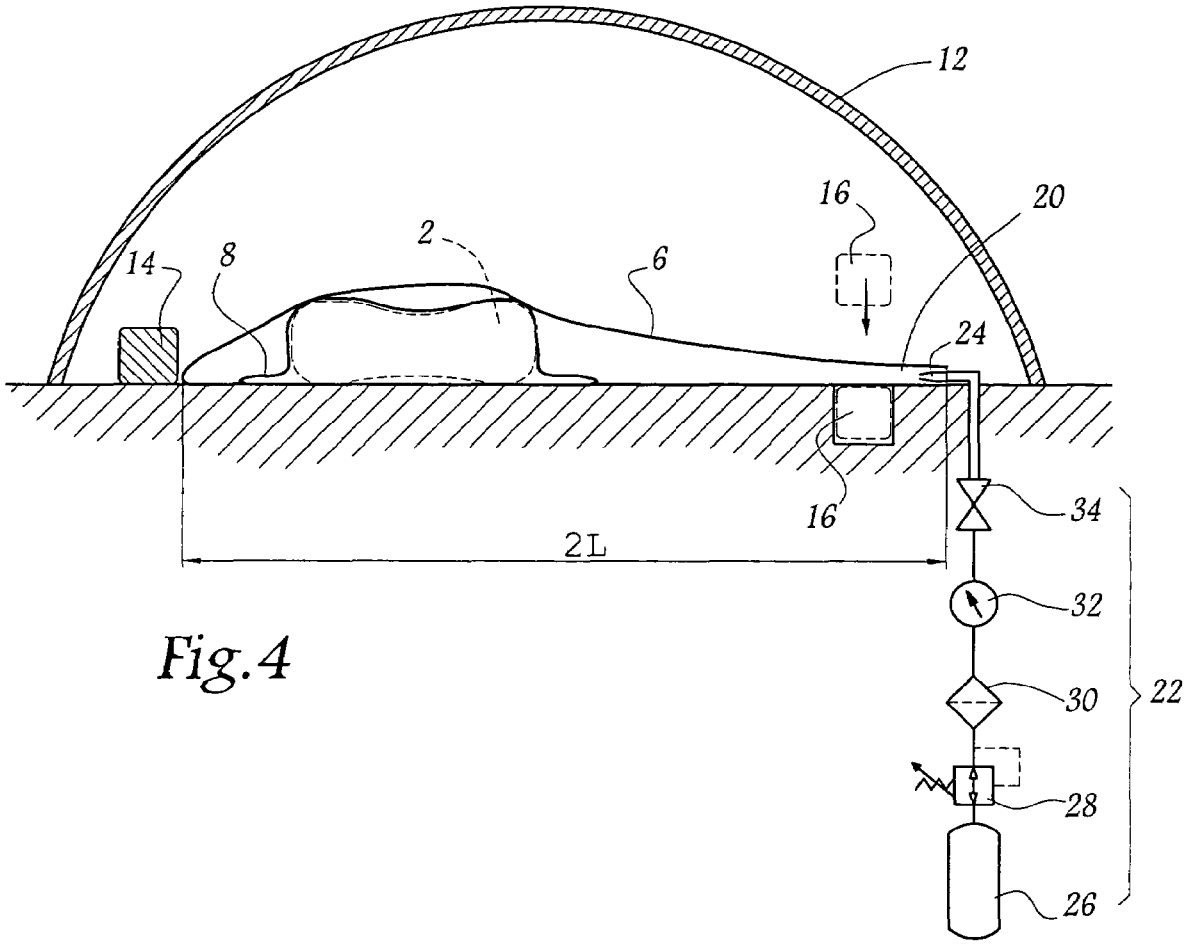
FIG. 4 is a view similar to FIG. 2, illustrating a second phase of the process carried out for obtaining the packaging of FIG. 1.

As shown in FIG. 4, the sachet 8 containing the implant 2 is then placed in the outer envelope 6 whose dimensions are advantageously a length equal to about 2×L and a width equal to about 1. To that end, the envelope 6 comprises an opening 20 adapted to be sealed b fusion of the polyamide which partly forms this sachet 8. The envelope 6 is positioned in the bell 12, using the positioning bar 14 previously displaced with respect to its position of FIG. 2, so that the opening 20 is disposed between the open jaws 16.

In addition to the afore-mentioned vacuum-creating means, the bell 12 comprises argon-injecting means 22 intended to form an inert gaseous atmosphere within the envelope 6.

Figure 5:
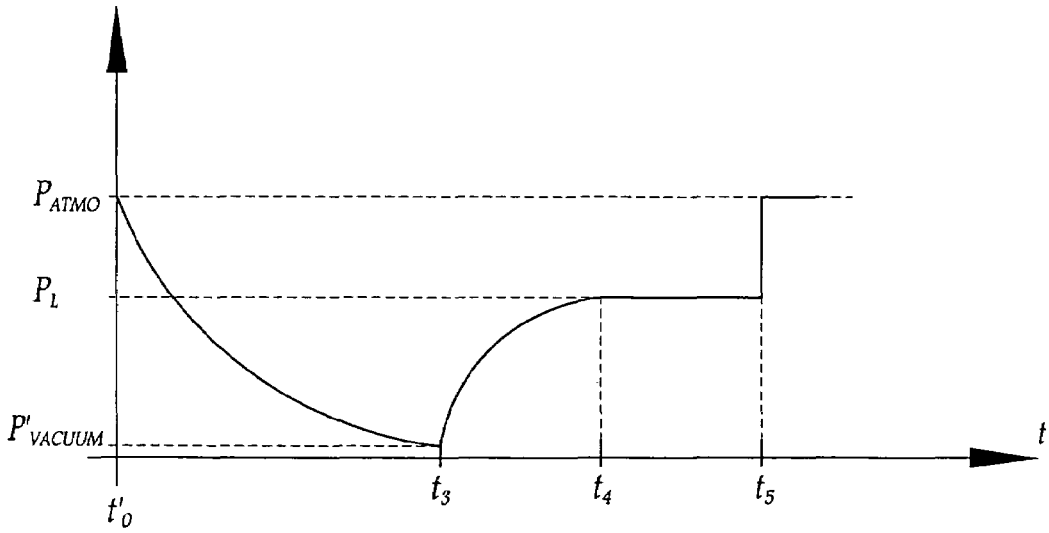
FIG. 5 is a diagram showing the variation of pressure as a function of time within an envelope used in the second phase of the process illustrated in FIG. 4.

More precisely, during a step represented between instants $t_0'$ and $t_3$ in FIG. 5, the air initially contained in the bell 12, including that in the envelope 6, is evacuated until the pressure prevailing inside the sachet 8 attains a value of some millibars, denoted $P'_{VACUUM}$ in FIG. 5. In order not to harm the integrity the inner sachet 8, care is taken that the value $P'_{VACUUM}$ is equal to or slightly greater than the value $P_{vacuum}$ of FIG. 3.

From $t_3$ to $t_4$, the injection means 22 are then employed so as to inject, via a nozzle 24 opening into the opening 20 of the envelope 6, argon coming from a bottle 26 storing argon at high pressure and passing successively from this bottle through a pressure reducing valve 28, a filtering member 30, a pressure gauge 32 and a control valve 34. The pressure gauge 32 ensures that the pressure of argon injected is of the order of 1 bar. The nozzle 24 is calibrated so that the flowrate of argon is sufficiently low and stable to avoid blowing of the envelope 6.

This injection step continues until the pressure prevailing inside the envelope 6 attains a predetermined value, denoted $P_L$ in FIG. 5, strictly less than atmospheric pressure, denoted $P_{ATMO}$. The pressure $P_L$ is chosen between 0.3 and 0.7 bar. It is advantageously about 0.5 bar.

At instant $t_4$, the jaws 16 are closed on themselves and, from $t_4$ to $t_5$, they weld the edges of the opening 20 to each other.

At instant $t_5$, the jaws are opened again, the arson injection means 22 is to stopped and the bell 12, after having possibly been re-pressurized further, is opened. The envelope 6 being hermetically closed, the gaseous atmosphere prevailing inside this envelope passes rapidly from pressure $P_L$ to atmospheric pressure $P_{ATMO}$ and the volume occupied by the envelope 6 is reduced by deformation in compression of the flexible multi-layer structure of the envelope 6.

The assembly formed by the implant 2, the envelope 6 and the sachet 8 is then placed inside the rigid packing 4, folding the envelope once on itself so that its space requirement in length is about L. The volume occupied by the envelope 6 is dimensioned so as to be inscribed in substantially complementary manner in the internal volume of the packing 4, with the result that the inner sachet 8 containing the implant is immobilized, as represented in FIG. 1.

In order to sterilize the implant 2, the packaging 1 formed by the implant 2, the envelope 6, the sachet 8 and the packing 4 is then exposed to γ (gamma) rays, possibly after having been transported up to a source of radiation.

All the packaging operations described hereinabove are carried out in a clean room.

The inert gaseous atmosphere formed by argon in the sterile packaging 1 thus obtained both ensures for the polyethylene implant a barrier against the ambient air, particularly the oxygen that it contains, in particular in the event of the tightness of the inner sachet being broken, and provides a function of immobilization ensuring shock absorption when the packaging is transported. The slight compression of the flexible outer envelope 6 when it is returned to atmospheric pressure tends to reinforce its tightness with respect to the ambient air, while cancelling the stresses of pressure between the interior and exterior of this envelope since the pressures prevailing on either side of the walls of the flexible envelope are equal.

Furthermore, the sterile packaging obtained is less expensive and occupies less space than a rigid packing in which an implant is mechanically immobilized, for example by shims of cellular material.

Various variants and arrangements of the process which has been described may be made including:

- apart from argon, the inert gaseous atmosphere of the outer envelope may be formed by nitrogen or a mixture of argon and nitrogen;
- the inner sachet may be of the same nature as the outer envelope, i.e. comprising layers of polyamide and polyethylene;
- the outer envelope may be formed by a rigid or semi-rigid shell;
- the bell provided with the means for injecting the inert gas inside the outer envelope may be different from the one creating a vacuum in the inner sachet; and/or the steps consisting in obtaining the inner sachet in vacuo on the one hand, and in obtaining the outer envelope with inert atmosphere on the other hand, may be successively carried out without returning the inner sachet to the open air, on condition that a bell provided with adequate means be available.

What is claimed is:

1. A process for the sterile packaging of a prosthetic implant made of polyethylene comprising:

successively placing the implant in a flexible, gas-impermeable sachet having an opening adapted to be sealed, creating a vacuum in the sachet and then sealing its opening;

placing the sachet containing the implant in a gas-impermeable envelope including an opening adapted to be sealed;

establishing an inert gaseous atmosphere in the envelope by injecting an inert gas inside the envelope until the pressure inside the envelope reaches a predetermined pressure less than atmospheric pressure;

closing the envelope hermetically by sealing its opening; and sterilizing the implant within the sachet and the envelope by irradiation, wherein a pressure of the inert gas in the envelope is greater than or equal to a pressure in the sachet.

2. The process of claim 1, wherein sealing the opening of the sachet and sealing the opening of the envelope comprise heat-sealing their respective openings.

3. The process of claim 1, wherein the inert gaseous atmosphere formed in the envelope is constituted by argon, nitrogen or a mixture of these gaseous elements.

4. The process of claim 1, wherein the sachet includes a layer of aluminum.

5. The process of claim 1, wherein the envelope includes a layer of a polyamide and a layer of a polyethylene.

6. The process of claim 1, wherein establishing the inert gaseous atmosphere in the envelope comprises:

creating a vacuum around and inside the envelope; and subjecting the envelope to atmospheric pressure after hermetically closing the envelope so that the inert gaseous atmosphere in the envelope has a pressure greater than the pressure in the sachet.

7. The process of claim 1, wherein the inert gas is injected into the envelope until a pressure of the inert gaseous atmosphere in the envelope reaches a predetermined value between about 0.3 and about 0.7 bar.

8. The process of claim 1, wherein, before or after irradiation of the implant, an assembly formed by the implant, the sachet and the envelope is placed in a rigid packing whose internal volume is substantially equal to a volume occupied by the assembly.

9. The process of claim 8, wherein, before placing the assembly formed by the implant, the sachet and the envelope in the rigid packing, the envelope is folded on itself.

10. The process of claim 8, wherein the rigid packing and the envelope cooperate by being of complementary shapes in order to immobilize the sachet containing the implant.

11. A process for the sterile packaging of a prosthetic implant that includes polyethylene, the process comprising:

sealing the prosthetic implant in a flexible, gas-impermeable sachet at a first pressure;

locating the sachet containing the prosthetic implant in a gas-impermeable envelope, the envelope including an opening adapted to be sealed;

establishing an inert gaseous atmosphere in the envelope;

hermetically sealing the opening so that the inert gaseous atmosphere in the envelope comprises a second pressure less than atmosphere pressure and greater than or equal to the first pressure in the sachet; and sterilizing the implant within the sachet and the envelope by irradiation.

12. The process of claim 11, wherein the sachet includes a layer of aluminum.

13. The process of claim 11, wherein the sachet is opaque to visible light.

14. The process of claim 11, wherein sealing the implant in the sachet comprises:

reducing a pressure in and around the sachet containing the prosthetic implant to about the first pressure; and sealing the sachet.

15. The process of claim 11, wherein sealing the implant in the sachet comprises:

evacuating the envelope containing the sachet and the prosthetic implant;

introducing an inert gas into the envelope at about the second pressure; and sealing the envelope.

16. The process of claim 11, wherein the inert gaseous atmosphere comprises argon, nitrogen, or a mixture thereof.

17. The process of claim 11, wherein the envelope comprises a layer of a polyamide and a layer of a polyethylene.

18. The process of claim 11, wherein the envelope comprises a rigid or semi-rigid material.

19. The process of claim 11, wherein establishing the inert gaseous atmosphere in the envelope comprises injecting an inert gas inside the envelope until a pressure inside the envelope reaches about the second pressure.

20. The process of claim 11, wherein the second pressure comprises a pressure of about 0.3 to about 0.7 bar.

21. The process of claim 11, and further comprising locating an assembly comprising the envelope containing the sachet and the prosthetic implant in a rigid container comprising an internal volume substantially equal to a volume occupied by the assembly.

22. The process of claim 11, and further comprising locating an assembly comprising the envelope containing the sachet and the prosthetic implant in a rigid container comprising an internal shape complementary to a shape of the assembly.

23. A process for the sterile packaging of a prosthetic implant that includes polyethylene, the process comprising:

locating the prosthetic implant in a flexible, gas-impermeable sachet;

locating the sachet containing the prosthetic implant in a gas-impermeable envelope;

reducing a pressure in and around the sachet containing the prosthetic implant to about a first pressure;

sealing the sachet;

evacuating the envelope containing the sachet and the prosthetic implant;

introducing an inert gas into the envelope;

sealing the envelope so that the inert gaseous atmosphere in the envelope comprises a second pressure less than atmospheric pressure and greater than or equal to the first pressure in the sachet; and sterilizing the envelope containing the implant within the sachet by irradiation.

24. The process of claim 23, wherein the envelope comprises a rigid or semi-rigid material.

25. The process of claim 23, wherein the second pressure comprises about 0.3 and about 0.7 bar.

26. A process for the sterile packaging of a prosthetic implant that includes polyethylene, wherein the prosthetic implant is sealed at a first pressure in a flexible, gas-impermeable sachet, the process comprising:

locating the sachet containing the prosthetic implant in a gas-impermeable envelope, the envelope including an opening adapted to be sealed;

establishing an inert gaseous atmosphere in the envelope;

hermetically sealing the opening so that the inert gaseous atmosphere in the envelope comprises a second pressure less than atmospheric pressure and greater than or equal to the first pressure in the sachet; and sterilizing the implant within the sachet and the envelope by irradiation.

27. The process of claim 26, wherein the envelope comprises a rigid or semi-rigid material.

28. The process of claim 26, wherein establishing the inert gaseous atmosphere in the envelope comprises injecting an inert gas inside the envelope until a pressure inside the envelope reaches about the second pressure.

29. The process of claim 26, wherein the second pressure comprises a pressure of about 0.3 to about 0.7 bar.

30. The process of claim 26, and further comprising locating an assembly comprising the envelope containing the sachet and the prosthetic implant in a rigid container comprising an internal volume substantially equal to a volume occupied by the assembly.

31. The process of claim 26, and further comprising locating an assembly comprising the envelope containing the sachet and the prosthetic implant in a rigid container comprising an internal shape complementary to a shape of the assembly.

* * * * *